United States Patent [19]

Jones et al.

[11] 4,214,674

[45] Jul. 29, 1980

[54] HYDRO PISTOL WITH PRESSURIZED WATER CONTAINER AND WITH VARIABLE WATER EJECTION CAPABILITY

[75] Inventors: Lawrence T. Jones, Playa Del Rey; Anson Sims, Granada Hills; Ashley G. Howden, Los Angeles, all of Calif.

[73] Assignee: California R & D Center, Culver City, Calif.

[21] Appl. No.: 910,883

[22] Filed: May 30, 1978

[51] Int. Cl.[2] ..... A63H 33/30

[52] U.S. Cl. ..... 222/79; 124/31; 124/73; 222/175; 222/401; 222/505; 222/528

[58] Field of Search ..... 124/31, 36, 73; 239/101; 222/79, 175, 401, 402, 505, 517, 528, 529; 251/7

[56] References Cited

U.S. PATENT DOCUMENTS

| | | | |
|---|---|---|---|
| 2,249,608 | 7/1941 | Greene | 222/79 |
| 2,281,142 | 4/1942 | Davis | 222/175 |
| 3,318,482 | 5/1967 | Voce | 222/79 |

FOREIGN PATENT DOCUMENTS

| | | | |
|---|---|---|---|
| 517724 | 10/1965 | Canada | 222/79 |
| 81956 | 9/1956 | Denmark | 222/79 |

*Primary Examiner*—David A. Scherbel
*Attorney, Agent, or Firm*—Jackson, Jones & Price

[57] ABSTRACT

A toy water gun assembly capable of ejecting water in bursts or in a continuous manner, is disclosed. A separate, pressurizable water container is connected by a flexible hose, to a pistal shaped member. A section of the flexible hose, mounted in the pistol shaped member, is continuously clamped by a lever. A spring biases the lever to prevent the release of a water stream through a nozzle which is mounted on the front of the pistol shaped member. A trigger member having a pointed pawl pivotably mounted thereto, is operatively connected to the lever. An initial movement of the pawl member caused by a quick pull on the trigger member momentarily removes the lever from its position clamping the hose. Additional movement of the pawl causes it to slide off the lever, thereby allowing the lever to return to its regular position wherein the hose is clamped. A control member is provided which may be adjusted to restrict the movement of the lever and the pawl whereby the pawl is rendered incapable of sliding off the lever. In this manner a continuous flow of water results upon depression of the trigger piece.

16 Claims, 7 Drawing Figures

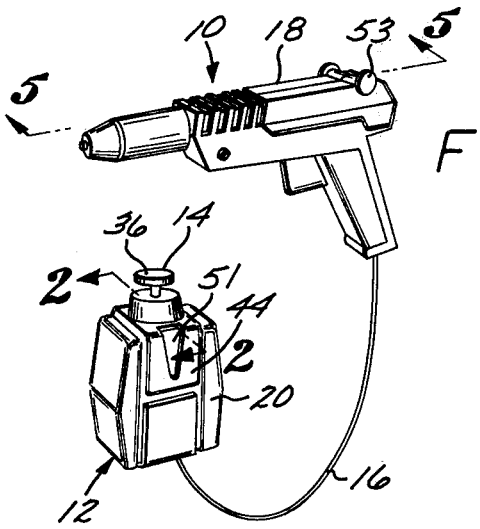
FIG. 1
FIG. 2
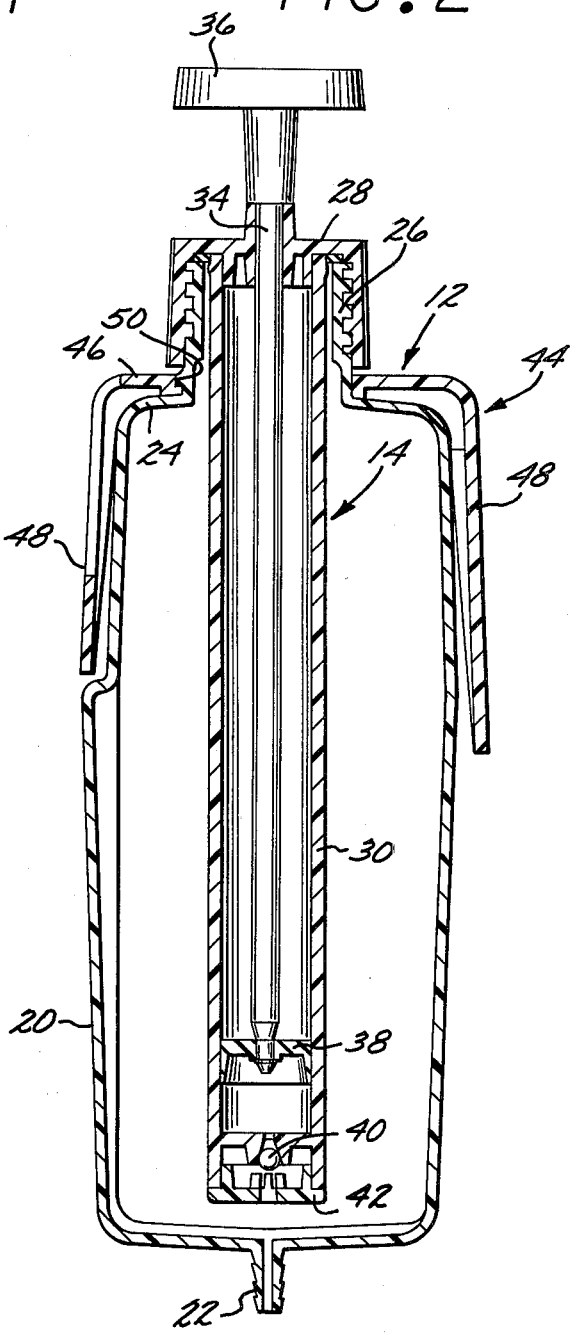
FIG. 3
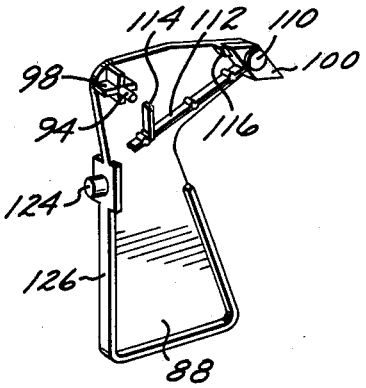
FIG. 4
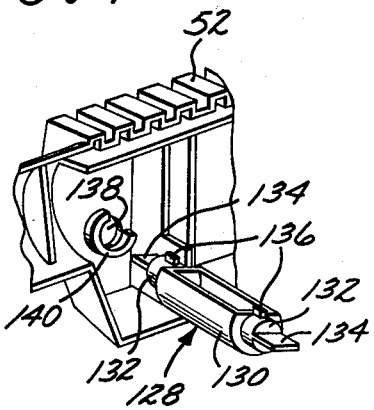

HYDRO PISTOL WITH PRESSURIZED WATER CONTAINER AND WITH VARIABLE WATER EJECTION CAPABILITY

BACKGROUND OF THE INVENTION

1. Field of the Invention

The present invention relates to a toy water pistol and more particularly to a toy water pistol having a pressurized water container and capable of selectively ejecting water in a pulse type or in a continuous fashion.

2. Description of the Prior Art

The prior art is well aware of toy water pistols. The toy water pistols of the prior art usually comprise a gun or pistol shaped member having a built in water container and a trigger. Movement of the trigger is usually transmitted to a pump built into the gun shaped member and results in a temporary increase of pressure in the water container. The increased pressure causes immediate ejection of water through a nozzle. However the above described toy water pistols of the prior art suffer from the drawback that the pressure which ejects the water from the water pistol is limited to that which can be attained by a single stroke of pull on the trigger piece. Consequently a shooting range of the toy water pistols of the prior art is limited thereby.

Additionally, the characteristics of the emitted water stream, that is quantity of water and duration are generally limited in the prior art. Also the storage capacity of the water pistols are usually limited.

Finally due to the inherent, ever changing nature of the toy market, there is a continuous need to supply toys of novel features which challenge the imagination and the manual dexterity of the children.

SUMMARY OF THE INVENTION

It is an object of this invention to provide a toy water pistol capable of ejecting a narrow stream of water a large distance.

It is another object of this invention to provide a toy water pistol which is capable of selectively ejecting water in a continuous or in a pulse type manner.

It is still another object of this invention to provide a toy water pistol of novel features which is capable of storing a relatively large amount of water.

It is yet another object of this invention to provide a toy water pistol wherein the water supply is contained in a container separate from the water pistol itself while maintaining an economical construction.

These and other objects and advantages are attained by a toy water pistol having a separate, pressurizable water container and a pistol shaped member which is connected to the pressurizable water container by a flexible hose.

The pistol shaped member has a nozzle for the ejection of the water, and a hose section connecting the water container with the pistol shaped member is operatively mounted to the nozzle within the pistol shaped member. The hose section is clamped by a lever which is pivotably mounted in a housing of the pistol shaped member and which is continuously biased by a spring. A trigger, also pivotably mounted in the housing and biased by a second spring, is operatively connected to the lever. The trigger incorporates a unique self biasing pawl member which upon motion of the trigger piece initially depresses the lever thereby moving it away from its position of clamping the hose. However, upon further motion of the trigger piece the pawl member slides off the lever thereby allowing the lever to return to its position clamping the hose. In this fashion a quick pull on the trigger piece results in the ejection under pressure of a pulse of water from the toy water pistol of the present invention.

In order to enable a child user of the present invention to select between a pulse or a continuous flow of water, a non-cylindrical adjusting member is pivotably and transversely mounted within the housing. The adjusting member positions one of the sides thereof having either a shorter or longer distance from the lever dependent on its rotational position. When the adjusting member is at a closer distance to the lever, the travel of the lever is limited thereby and the pawl member is likewise limited in movement and is incapable of sliding off the end of the lever when the trigger piece is pulled. Consequently in this position of the adjusting member the lever is held from clamping the hose as long as the trigger piece is pulled and a continuous flow of water is ejected through the nozzle.

The objects and features of the present invention are set forth with particularity in the appended claims. The present invention may be best understood by reference to the following description taken in connection with the accompanying drawings in which like numerals indicate like parts.

BRIEF DESCRIPTION OF THE DRAWINGS

FIG. 1 is a perspective view of the toy water gun assembly of the present invention;

FIG. 2 is a cross sectional view of a water container for the toy water gun assembly of the present invention, the cross section taken at lines 2—2 of FIG. 1;

FIG. 3 is a perspective back side view of a trigger pawl assembly of the present invention;

FIG. 4 is a perspective, exploded view of a section of a housing of the pistol shaped member of the present invention with an adjusting member being positioned for mounting therein;

DESCRIPTION OF THE PREFERRED EMBODIMENT

Figure 5:
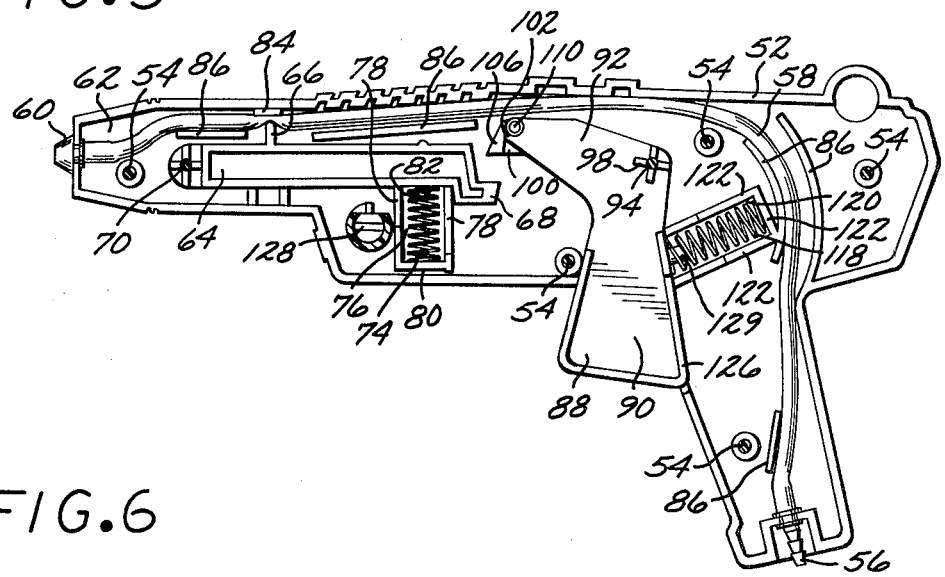
FIG. 5 is a cross sectional side view along lines 5—5 of the pistol shaped member of the present invention with a hose in the pistol shaped member being clamped.

The following specification taken, in conjunction with the drawings, sets forth the preferred embodiment of the present invention in such a manner that any person skilled in the toy manufacturing arts can use the invention. The embodiment of the invention disclosed herein is the best mode contemplated by the inventor for carrying out his invention in a commercial environment, although it should be understood that various modifications can be accomplished within the parameters of the present invention.

Referring specifically to FIGS. 1, 5, 6 and 7 the toy water gun assembly 10 of the present invention is disclosed. A water container 12 capable of being pressurized by strokes of a hand pump 14 is connected with a flexible hose to a pistol shaped member 18.

The design and construction of the water container 12 is best shown on the cross sectional view of FIG. 2. Preferrably the parts are molded from plastic. A substantially box shaped member container housing 20 is provided with a water outlet tube 22 at the bottom thereof. The water outlet tube 22, due to its tapered design, is particularly adapted for removable attachment with a flexible hose 16. A top portion 24 of the box shaped container housing 20 is provided with a cylindrically shaped, threaded neck 26 onto which fits a complementarily threaded top cover 28. A tubularly shaped pump housing is concentrically and fixedly attached to the top cover 28, a circular hole 32 being provided in the center of the top cover 28 to accommodate a pump shaft 34. A circularly shaped hand piece 36 is mounted to the pump shaft 34 on the top end thereof which is utilized for pumping. A piston 38 is press fitted to substantially the bottom of the pump shaft 34, and a suitable ball valve 40 is provided in an opening in the bottom 42 of the hollow cylindrical pump housing 30.

A clip 44 having a substantially rectangular base plate 46 and two parallel slide plates 48, disposed substantially at right angles to the base plate 46, is provided with a circular aperture 50 in the center of the base plate 46. The circular aperture 50 allows the mounting of the clip 44 on the threaded neck 26 of the water container 12. The purpose of the above described clip 44 is to enable a child user of the present invention to clip the water container 12 onto a belt worn by the the child. A triangularly shaped slot 51 provided on one of the side plates 48 may receive for storage of the pistol shaped member 18 a button type protrusion 53 on the pistol shaped member 18. Thus the pistol member 18 can be worn as if the container 12 was a holster.

As it should be readily apparent from the above description, when the water container 20 is partially filled with water leaving an airspace above the water level (not shown), pressure is created in the water container 20 by pumping the hand pump 14. By pumping the hand pump 14 in several strokes larger pressure may be created in the container than is usually attained in the water pistols of the prior art. In order to provide for a satisfactorily long continuous operation of the toy water gun assembly 10 without a need to repressurize the container 12 it is desirable to fill the water container 12 only approximately three quarters to half full so as to allow a sufficiently large airspace therein.

Figure 6:
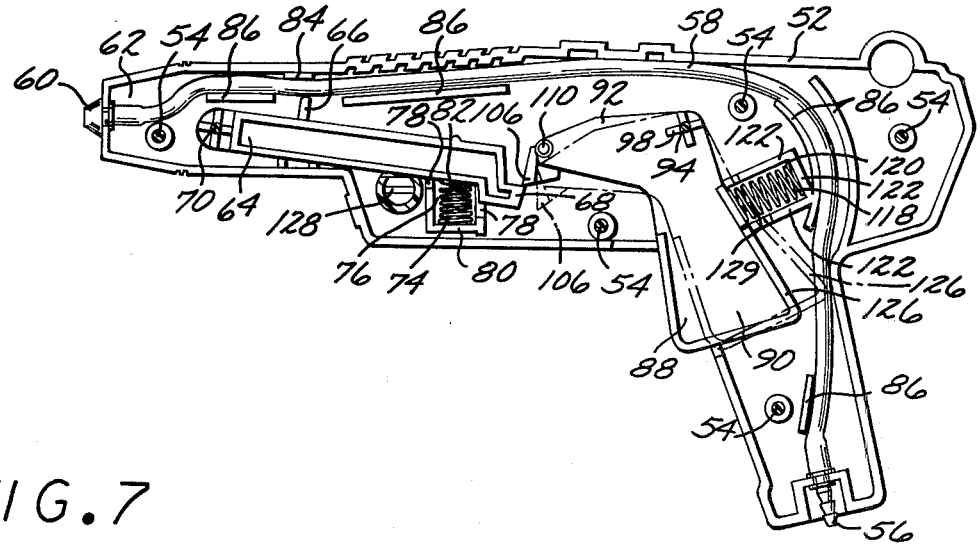
FIG. 6 is a cross sectional side view of the pistol shaped member of the present invention with the trigger being depressed to release a pulse of water.
Figure 7:
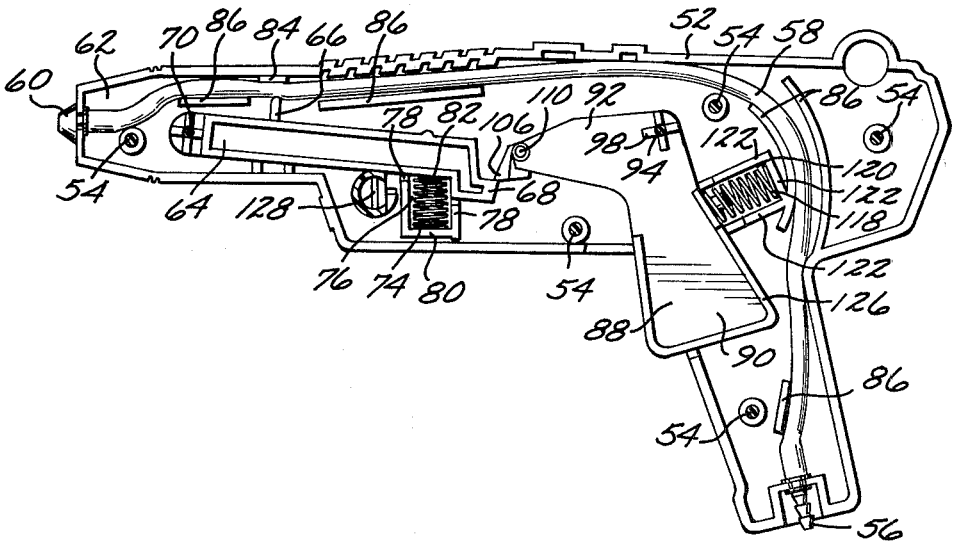
FIG. 7 is a cross sectional side view of the pistol shaped member of the present invention with the trigger being depressed to provide for continuous flow of water.

Referring now specifically to FIGS. 1, 5, 6 and 7, it should be readily apparent that the water driven by the pressure existing in the water container 12 flows through the flexible hose 16 and is readily ejected by the pressure from the end of the hose 16 unless the hose is clamped. FIGS. 5, 6 and 7 show the operation of the mechanism adapted for clamping the hose and for allowing selective ejection of either a burst or a continuous flow of water therefrom.

The pistol shaped member 18 illustrated in cross sectional views on FIGS. 5, 6 and 7 comprises a housing 52 which is readily manufactured from two complementary pieces of molded plastic material. The complementary pieces of plastic material are readily held together in the assembled pistol shaped member 18 by a plurality of screws (not shown), the screws being received by internally threaded hollow cylindrical members 54 which are conveniently molded integrally with the housing 52.

A tapered inlet connector 56 is provided in the bottom of the housing 30 of the pistol shaped member 18 to which the flexible hose 16 is connected in the operative toy water gun assembly 10. An additional section of a flexible hose 58 is mounted within the housing 52. The hose section 58 terminates in a nozzle orifice member 60 provided in the front barrel section 61 of the pistol shaped member 18. The nozzle 60 is designed for maximum distance of ejection of the water under pressure in a narrow stream.

A lever 64 having a cross bar 66 disposed transversely to a general longitudinal axis of the lever 64, and the barrel section 61 is mounted for pivotal movement within the housing 52. A relatively short orthogonal portion 68 extends from one end of the lever 64. The pivotable mounting of the lever 64 is readily accomplished by inserting two small cylindrical extensions 70, disposed on either side transversely to the general longitudinal axis of the lever 64, into two complementary, cylindrically shaped hollow bearings (not shown) provided in the housing 52. It is to be noted that the lever 64 is mounted into the bearings in substantially the front section of the generally elongated shaped lever 64 closest to the barrel 62 while the orthogonal portion 68 is located at the opposite rearmost end of the lever 64, the cross bar 66 extending upward from the lever 64 in an intermediate portion thereof.

A first coil spring 74 contained in a vertically disposed channel 76 is in contact with the lower rear portion of the lever 64, the spring 74 substantially abutting the orthogonal portion 68. The vertically disposed channel 76 is formed between vertically disposed plates 78 which comprise integral parts of the molded housing 52. The first spring 74 is further contained in the vertically disposed channel 76 by a horizontal plate 80 which also comprises an integral part of the molded housing 52. A short cylindrically shaped stub 82 extending from the lower rear portion of the lever 64 is inserted into the first coil spring 74 preventing the same from sliding out of operative positon. The function of the first coiled spring 74 is to continuously bias the lever 64 in an upwardly direction and to press the cross bar 66 against the hose section 58 which, as a result, is pinched off between the cross bar 66 and an horizontally disposed plate 84. The plate 84 which extends from the housing 52 is also conveniently manufactured as an integral part of the molded plastic housing 52 and can be further supported by a complimentary plate (not shown) extending over it from the other housing half. The hose section 58 is further held in place by a plurality of plates 86 extending from the molded housing 52.

A one piece trigger plate 88 having a substantially trapezoidal shaped lower portion 90 and a substantially triangularly shaped upper portion 92 is mounted for pivotal movement in the housing 52. The mounting of the trigger plate 88 is analogous to the mounting of the lever 64, thus it is accomplished by placing cylindrical extensions 94 of the trigger plate 88 into hollow cylindrically shaped bearings (not shown) provided as an integral part of the molded plastic housing 52. In order to align the trigger plate 88 in operative position in substantially the center of the toy pistol housing 52, the cylindrical extensions 94 which extend transversely from the general plane defined by the trigger plate 88, are provided with cross shaped aligning members 96. The cross shaped aligning members 96 being located on either side of the trigger plate 88 and extending therefrom to a lesser distance than the cylindrical extensions 94 to prevent transverse sliding of the cylindrical extensions 94 in the hollow cylindrical bearings (not shown)

and therefore assure proper alignment of the trigger plate 88 in the housing 52. Alignment of the lever 64 in operative positon in substantially the center of the housing 52 is accomplished in a similar manner.

A pawl member 100, comprising a separate part from the trigger plate 88, is mounted on the front end 102 of the triangularly shaped upper portion 92 of the trigger plate 88. The pawl member 100 and its mounting to the trigger plate 88 is also shown on FIG. 3. The pawl member 100 comprises a rhomboid shaped plate which has a circular aperture (not shown) and a triangularly shaped side extension 106 shown in FIGS. 5, 6 and 7. The side extension 106 is disposed in a plane transverse to the general plane defined by the trigger plate 88 in such a manner that the side triangular extension 106 forms a ridge substantially abutting the front end 102 of the triangular portion 92 of the trigger plate 88. The pawl member 100 is mounted upon the trigger plate 88 by placing a hollow cylindrical extension (not shown) of the trigger plate 88 into the circular aperture (not shown) provided in the pawl member 100 and by inserting a plastic, cotter pin type member 110 through the aperture and through a corresponding aperture (not shown) provided in the trigger plate 88.

Referring specifically to FIG. 3 a thin plastic spring type extension 112 is integrally molded with and extends from the pawl member 100. The spring type extension 112 comprises an integral part of the plastic pawl member 100 and is in contact with a plate 114 which extends transversely from the trigger plate 88. An additional small, transverse extension 116 of the trigger plate 88 is disposed parallel to one side of the pawl member 100 and abuts the same.

As a result of the above described structure and of the mounting of the pawl member 100 thereinto, the pawl member 100 is capable of limited pivotal movement on the cotter pin type member 110 which acts as an axle of rotation. When the pawl member 100 is forced to undergo limited rotational movement relative to the trigger plate 88 the spring type extension 112 is bent, and due to its inherent elasticity urges the pawl member 100 to reverse its rotational movement. The small extension 116 abutting one side of the pawl member 100 further restricts the rotational movement of the pawl member 100 by limiting the movement of the spring type extension 112. Consequently as the force causing the limited rotational movement of the pawl member 100 is withdrawn, the plastic spring type extension 112 engaged by the plate 114 returns the pawl member 100 into its maximum possible extended position. The purpose of the above described arrangement biasing the pawl member 100 into a maximum extended position relative to the trigger plate 88 will be best understood as the operation of the toy water pistol of the present invention is further explained below.

Referring to FIGS. 5, 6 and 7 a second coil spring 118 which biases the trigger plate 88 away from contact with the lever 64, is disclosed. The second coil spring 118, similarly to the first coil spring 74, is mounted in a channel 120 which is formed between a plurality of plates 122 comprising an integral part of the molded plastic housing 52. A short stub 124 provided on a back edge 126 of the trapezoidal shaped lower portion 90 of the trigger plate 88 is inserted into the second spring 118 thereby preventing it from accidentally moving out of operative position. FIG. 5 illustrates the trigger plate 88 as it is biased away from the lever 64. The latter is the position of the trigger plate 88 when the toy water pistol comprising the subject of the present invention is not ejecting water. As FIG. 5 clearly shows it, the hose section 58 is clamped between the cross bar 66 provided on the lever 64 and the horizontal plate 84, consequently water is contained in the system despite the fact that the pressure exists in the container 12.

FIGS. 5, 6, 7 and with more particularity FIG. 4 disclose an adjusting member 128 which enables a child to select between a pulse type or continuous flow type discharging mode of the toy pistol of the present invention. The adjusting member 128 comprises a substantially cylindrically shaped, hollow main body 130, two smaller cylindrical members 132 one of each being disposed concentrically to the main bod 130 at either ends thereof, and two flat plates 134 each extending from the smaller cylindrical members 132 in a plane defined by the general longitudinal axis of the adjusting member 128. In addition, a small prong 136 is provided on the circular periphery of each smaller cylindrical member 132. The exact shape of the main body 130 of the adjusting member 128 in this preferred embodiment is that of a cylinder from which a section has been removed along a plane parallel to the longitudinal axis of the cylinder. The purpose of this particular shape of the main body of the adjusting member 130 and the function of the adjusting member 128 will be readily understood as the operation of the toy pistol of the present invention is further explained below.

The adjusting member 128 is mounted into two aligned circular apertures 138 located in the housing 52 with the longitudinal axis of the adjusting member 128 transverse to the longitudinal axis of the housing 52. The circular apertures 138 (only one of which is shown on FIG. 4) disposed on both sides of the housing 52 are rimmed with inwardly extending extensions 140 having the shape of a ring from which approximately a 90° segment has been removed. The smaller cylindrical members 132 on each side of the adjusting member are placed into the respective circular apertures 138, the plates 134 of the adjusting member 128 extending outwards from both sides of the housing 52. As the adjusting member 128 is mounted into operative position it becomes capable of only limited rotational movement since the extensions 140 restrict the rotational freedom of the prongs 136 on both sides of the adjusting member 128.

As a result of the above described structure a child user of the toy pistol of the present invention may select between two different positions of the adjusting member 128. Referring again to FIGS. 5 and 6, the child may rotate the adjusting member 128 into a position wherein the prongs 136 point toward the lever 64 and the closest periphery of the adjusting member 128 to the lever 64 is as far removed from the lever 64 as the above described structure will permit.

As it should be readily apparent from the above, detailed structural description of the entire pistol shaped member of the present invention and from the Figures when the trigger plate 88 is pulled the pawl member 100 transmits the pivotal motion of the trigger plate 88 to the lever 64 and thereby depresses the lever 64. As the lever 64 is depressed, as shown in FIG. 6, the cross bar 66 ceases to clamp the hose section 58 consequently water is ejected under pressure through the nozzle 60. However, upon further pivotal motion of the trigger plate 88 the pointed pawl member 100 slides off from the orthogonal portion 68 of the lever 64 and the first coil spring 74 pushes the lever 64 back into the position wherein the hose section 58 is clamped again. Consequently a quick, strong pull on the trigger plate 88 by the child user of the present invention removes the lever 64 from its position clamping the hose section 58 only momentarily and therefore only a quick pulse of water is ejected through the nozzle 60.

As the trigger plate 88 is released by the child it pivots in an upwardly direction under the biasing force exerted by the second coil spring 118, and since the pawl member 100 is itself capable of limited movement it slides by the orthogonal portion 68 whereby the trigger plate 88 becomes repositioned in its normal resting position. At the same time the pawl member 100 being biased by the thin plastic spring type extension 112 resumes its extended position and the toy pistol is ready to eject another burst of water upon a subsequent pull on the trigger 88.

Alternatively a child user of the present invention may rotate the adjusting member 128 in a position shown on FIG. 7 wherein the substantially cylindrically shaped main body 130 is disposed in maximum possible proximity to the lever 64. In this selected position, downward movement of the lever 64 is restricted by the adjusting member 128. As the trigger plate 88 is pulled by a child user of the present invention the trigger plate 88 via the pawl member 100 depresses the lever 64 to the maximum distance permitted by the adjusting member 128. However since the movement of the lever 64 is restricted it does not move sufficiently to allow the pawl member 100 to slide off from the orthogonal portion 68. Consequently as long as the trigger plate 88 is pulled, the lever 64 stays depressed and passage of water through the hose section 58 is not impeded. As a result, water is ejected from the nozzle 60 in a continuous flow under the pressure which exists in the container 12. FIG. 7 illustrates the pistol shaped member of the present invention in the position capable of continuously ejecting water.

What has been described above is a toy water gun assembly capable of selectively ejecting water in a burst or in an uninterrupted flow, the water being propelled by a continuous pressure present in a separate water container. It will be readily apparent to those skilled in the toy manufacturing arts that various modifications of the present invention are possible and accordingly the scope of the present invention should be interpreted solely from the following claims.

What is claimed is:

1. An improved toy water gun assembly for providing an extended projection of water comprising:

a portable container for storing water;

means for pressurizing the container to provide and maintain a supra-atmospheric pressure in the container to propel the water;

means for transporting the container in a position relative to the operator to permit pressurization of the container;

gun means fluidly connected to the container for permitting relative movement to permit discretionary aiming and for releasing a predetermined projection of water including, a housing, a flexible hose, a nozzle with an orifice limiting the water projection to a narrow stream, the hose and the nozzle being mounted in the housing, and means for clamping the hose comprising a lever pivotally mounted in the housing, a first spring, the first spring continuously biasing the lever against the hose thereby clamping the same, a trigger piece pivotally mounted in the housing, the trigger piece being operatively connected to the lever, and a second spring, the second spring being mounted in the housing and urging the trigger piece away from the lever, a force exerted by the second spring capable of being overcome by a pressure pulling the trigger whereby a motion of the trigger piece is transmitted to the lever causing the lever to move away from the hose allowing flow of water therethrough.

2. The invention of claim 1 wherein the container further has means for attachment to a belt of an operator.

3. The invention of claim 2 wherein the container further has means for removably supporting the gun means.

4. The invention of claim 1 wherein the container is separate from the gun means, and the means for pressurizing the container pressurizes an airspace contiguous to a space for accomodating the water in the container.

5. The invention of claim 4 wherein the means for pressurizing the container comprise a hand pump.

6. The invention of claim 4 wherein the container further comprises a clip suitable for removably fastening the container unto a belt worn by an operator.

7. The invention of claim 1 wherein the gun means are adapted for releasing one of a pulse and a continuous flow of water.

8. The invention of claim 1 wherein the trigger piece includes a pawl member mounted upon the trigger piece for limited pivotal motion relative thereto, and biasing means to bias the pawl member to an extended position, the pawl member depressing the lever upon limited pivotal motion of the trigger piece, the pawl member sliding off the lever upon further pivotal motion of the trigger piece whereby the lever is no longer depressed.

9. The invention of claim 8 wherein the gun means further comprise an adjusting member mounted transverse to the housing for pivotal movement therein and partially extending therefrom, a cross section of the adjusting member taken along a plane transverse to its axis of rotation having at least two different dimensions, the adjusting member capable of being rotated to place one of the two dimensions adjacent to the lever, the larger of the two dimensions limiting the pivotal movement of the lever whereby the pawl member becomes incapable of sliding off the lever.

10. The invention of claim 9 wherein the container comprises a part separate from the gun means, and the means for pressurizing the container pressurizes an airspace contiguous to a space utilized for accomodating the water in the container.

11. The invention of claim 10 wherein the means pressurizing the container comprise a hand pump.

12. A toy water gun assembly comprising:

a container for water;

a hand pump adapted for pressurizing the container for water;

a separate gun shaped member movable relative to the container and having a nozzle with an orifice to release the pressurized water;

means for transferring the water under pressure from the container to the gun shaped member including a hose mounted within the gun shaped member and operatively attached to the nozzle, and control means operatively connected to the gun shaped member for blocking and selectively releasing one of a continuous flow and a pulse of water, including a lever, a first spring continuously biasing the lever against the hose thereby clamping the same, a trigger piece operatively connected to the lever and a second spring biasing the trigger piece away from the lever thereby maintaining the lever in a position clamping the hose.

13. The invention of claim 12 wherein the trigger piece includes a pawl member mounted for limited pivotal motion upon the trigger piece and a third spring biasing the pawl member, the pawl member positioned to transmit limited motion of the trigger piece to the lever thereby depressing the lever, the pawl member sliding off the lever upon further motion of the trigger piece thereby allowing the first spring to bias the lever against the hose and to clamp the same.

14. The invention of claim 13 wherein the control means further comprise an adjusting member pivotably mounted within the gun shaped member, a periphery of the adjusting member capable of being disposed at one of a longer and a shorter distance from the lever dependent upon a rotational position of the adjusting member, the lever being capable of a lesser pivotal movement when the adjusting member is disposed at the shorter distance than when the adjusting member is disposed at a longer distance therefrom, the lesser pivotal movement of the lever being insufficient to allow the pawl member to slide off the lever.

15. A toy water gun assembly comprising:

a container for water;

a hand pump adapted for pressurizing the container for water;

a separate gun shaped member movable relative to the container and having an orifice to release the pressurized water;

means for transferring the water under pressure from the container to the gun shaped member, and control means operatively connected to the gun shaped member for blocking and selectively releasing one of a continuous flow and a pulse of water, including a lever operatively mounted to clamp the hose, a trigger piece capable of removing the lever from contact with the hose, and adjusting means for selectively restricting the movement of the lever.

16. The invention of claim 15 wherein the container further comprises a clip suitable for removably fastening the container unto a belt worn by an operator.

* * * * *